US011035349B2

(12) United States Patent
Kim et al.

(10) Patent No.: US 11,035,349 B2
(45) Date of Patent: Jun. 15, 2021

(54) LINEAR COMPRESSOR

(71) Applicant: LG ELECTRONICS INC., Seoul (KR)

(72) Inventors: Hyunsoo Kim, Seoul (KR); Geonwoo Kim, Seoul (KR); Chulgi Roh, Seoul (KR)

(73) Assignee: LG Electronics Inc., Seoul (KR)

( * ) Notice: Subject to any disclaimer, the term of this patent is extended or adjusted under 35 U.S.C. 154(b) by 61 days.

(21) Appl. No.: 16/285,679

(22) Filed: Feb. 26, 2019

(65) Prior Publication Data

US 2019/0264668 A1 Aug. 29, 2019

(30) Foreign Application Priority Data

Feb. 26, 2018 (KR) ..... 10-2018-0022977

(51) Int. Cl.

| | |
|---|---|
| ***F04B 9/107*** | (2006.01) |
| ***F04B 7/02*** | (2006.01) |
| ***F04B 53/06*** | (2006.01) |
| ***F04B 39/14*** | (2006.01) |
| ***F04B 35/04*** | (2006.01) |
| ***F04B 39/00*** | (2006.01) |
| *F04B 39/12* | (2006.01) |

(52) U.S. Cl.

CPC ..... *F04B 9/107* (2013.01); *F04B 7/02* (2013.01); *F04B 35/045* (2013.01); *F04B 39/00* (2013.01); *F04B 39/14* (2013.01); *F04B 53/06* (2013.01); *F04B 39/121* (2013.01); *F04B 2203/09* (2013.01)

(58) Field of Classification Search

CPC ..... F04B 9/107; F04B 7/02; F04B 35/045; F04B 39/00; F04B 39/14; F04B 53/06; F04B 39/121; F04B 2203/09

USPC ..... 417/416

See application file for complete search history.

(56) References Cited

U.S. PATENT DOCUMENTS

2005/0098031 A1* 5/2005 Yoon ..... F04B 35/045 92/84
2006/0250032 A1 11/2006 Her
2007/0134108 A1 6/2007 Her
(Continued)

FOREIGN PATENT DOCUMENTS

KR 1020160024217 3/2016
KR 10-2017-0124899 11/2017

OTHER PUBLICATIONS

Extended European Search Report in European Application No. 19159358.1, dated May 22, 2019, 9 pages.

*Primary Examiner* — Connor J Tremarche
(74) *Attorney, Agent, or Firm* — Fish & Richardson P.C.

(57) ABSTRACT

A linear compressor includes: a piston configured to reciprocate along an axial direction of the linear compressor; a resonance spring configured to elastically support the piston along the axial direction; a motor assembly configured to provide a driving force to the piston, the motor assembly including a magnet that is disposed radially outside the piston; and a supporter configured to be coupled to the piston, the magnet, and the resonance spring. The supporter includes: a piston coupler coupled with the piston; a magnet coupler coupled with the magnet; and a spring coupler coupled with the resonance spring. The piston coupler, the magnet coupler, and the spring coupler are integrally formed by aluminum die casting.

19 Claims, 9 Drawing Sheets

(56) References Cited

U.S. PATENT DOCUMENTS

| | | | | |
|---|---|---|---|---|
| 2011/0194957 | A1* | 8/2011 | Kang | F04B 35/045 417/415 |
| 2015/0004028 | A1* | 1/2015 | Kang | F04B 39/12 417/417 |
| 2017/0298913 | A1 | 10/2017 | Kim et al. | |

* cited by examiner

LINEAR COMPRESSOR

CROSS-REFERENCE TO RELATED APPLICATION

The present application claims the benefit of an earlier filing date and right of priority to Korean Patent Application No. 10-2018-0022977, filed on Feb. 26, 2018, in Korea, the entire contents of which is incorporated herein by reference.

TECHNICAL FIELD

The present disclosure generally relates to a linear compressor.

BACKGROUND

In general, a compressor is a mechanical apparatus that increases the pressure of air, a refrigerant, or other various working gases by compression using power from a power generator such as an electric motor or a turbine. Compressors are generally used for appliances or in other aspects of industry.

Compressors can be broadly classified as a reciprocating compressor, a rotary compressor, and a scroll compressor.

In a reciprocating compressor, a compression space is formed between a piston and a cylinder. A working gas is suctioned into or discharged from the compression space. The piston compresses a refrigerant by reciprocating straight, or linearly, in the cylinder.

In a rotary compressor, a compression space is formed between a roller and a cylinder. A working gas is suctioned into or discharged from the compression space. The roller compresses a refrigerant by eccentrically rotating on the inner side of the cylinder.

In a scroll compressor, a compression space is formed between an orbiting scroll and a fixed scroll. A working gas is suctioned into or discharged from the compression space. The orbiting scroll compresses a refrigerant by rotating on the fixed scroll.

SUMMARY

In one aspect, a linear compressor includes: a piston configured to reciprocate along an axial direction of the linear compressor; a resonance spring configured to elastically support the piston along the axial direction; a motor assembly configured to provide a driving force to the piston, the motor assembly comprising a magnet that is disposed radially outside the piston; and a supporter configured to be coupled to the piston, the magnet, and the resonance spring. The supporter comprises: a piston coupler coupled with the piston; a magnet coupler coupled with the magnet; and a spring coupler coupled with the resonance spring. The piston coupler, the magnet coupler, and the spring coupler are integrally formed by aluminum die casting.

In some implementations, the piston coupler has a circular flat plate shape that extends in a radial direction, and the magnet coupler extends axially in a forward direction on an outer side of the piston coupler.

In some implementations, the piston coupler comprises: a muffler hole configured to receive a suction muffler; and piston holes that are arranged radially outside the muffler hole and that are configured to receive piston fasteners for coupling the piston.

In some implementations, the piston comprises: a piston body having a cylindrical shape and extending along the axial direction; and a piston flange extending along the radial direction from the piston body. The piston coupler is configured to contact the piston flange and to couple with the piston flange by the piston fasteners.

In some implementations, the linear compressor further includes: a magnet frame having a cylindrical shape that extends in the axial direction and that has the magnet attached to the outer side thereof; and a magnet-fixing member that surrounds the outer side of the magnet frame, and that is configured to fix the magnet to the magnet frame.

In some implementations, the magnet frame is at least partially bonded to an inner side of the magnet coupler, and at least a portion of the magnet-fixing member surrounds the outer side of the magnet coupler.

In some implementations, the spring coupler is axially spaced from the piston coupler and the magnet coupler, and protrudes in the radial direction further than the piston coupler and the magnet coupler.

In some implementations, the supporter comprises: spring bridges configured to connect a plurality of spring couplers; and body bridges configured to connect the spring bridges, the piston coupler, and the magnet coupler.

In some implementations, the spring bridges have a ring shape connecting the spring couplers that are circumferentially spaced from each other.

In some implementations, the linear compressor further includes: assistant bridges that extend in the radial direction outward from the spring couplers, and that each connects a respective pair of the spring couplers.

In some implementations, an axial length of the assistant bridges is larger than an axial length of the spring couplers.

In some implementations, the body bridges extend in the axial direction from the spring couplers to the piston coupler and to the magnet coupler.

In some implementations, the supporter further comprises: assistant bridges configured to connect a plurality of spring couplers, wherein an axial length of the assistant bridges is larger than an axial length of the spring couplers.

In some implementations, the axial length of the assistant bridges is twice the axial length of the spring couplers.

In some implementations, the spring couplers are composed of a plurality of pairs of spring couplers that are circumferentially spaced from each other, and the assistant bridges each connects a respective pair of the spring couplers.

The details of one or more implementations are set forth in the accompanying drawings and the description below. Other features will be apparent from the description and drawings, and from the claims.

DETAILED DESCRIPTION

In some scenarios, linear compressors implement a piston that is directly connected to a driving motor that generates a straight reciprocating motion. Such linear compressors can improve compression efficiency with a simple structure, while reducing mechanical loss due to conversion of motions.

A linear compressor typically suctions, compresses, and then discharges a refrigerant by reciprocating the piston along a straight direction in a cylinder, for example using a linear motor in a sealed shell.

In the linear motor, a magnet may be disposed between an inner stator and an outer stator, and the magnet may be reciprocated linearly by a mutual electromagnetic force between the magnet and the inner (or outer) stator. Further, the magnet may be operated while being connected to the piston, so that the piston suctions, compresses, and then discharges a refrigerant by reciprocating linearly in the cylinder.

In some structures, the permanent magnet and the piston compress a refrigerant by motion, and may implement a supporter and a magnet frame that connect the permanent magnet and the piston to each other.

The supporter and the magnet frame may be manufactured in metal plate shapes and combined with each other by a coupler. In such structures, the coupler and a coupling processor may increase manufacturing cost and manufacturing time.

Further, in such structures, the weight of an operation mechanism may be increased by the supporter and the magnet frame, so that operating the operation mechanism at a higher operation frequency may be difficult.

Implementations of the present disclosure may alleviate such problems by providing a linear compressor that can be operated at a relatively high operation frequency by reducing the weight of an operation mechanism.

In some implementations of the present disclosure, a linear compressor includes an all-in-one supporter that can be freely changed in shape by being manufactured through aluminum die casting without a change in strength and is reduced in weight.

In some implementations of the present disclosure, a linear compressor has a relatively simple coupling structure because the all-in-one supporter is combined with a magnet, a piston, and a resonance spring.

Reference will now be made in detail to the implementations of the present disclosure, examples of which are illustrated in the accompanying drawings.

Figure 1:
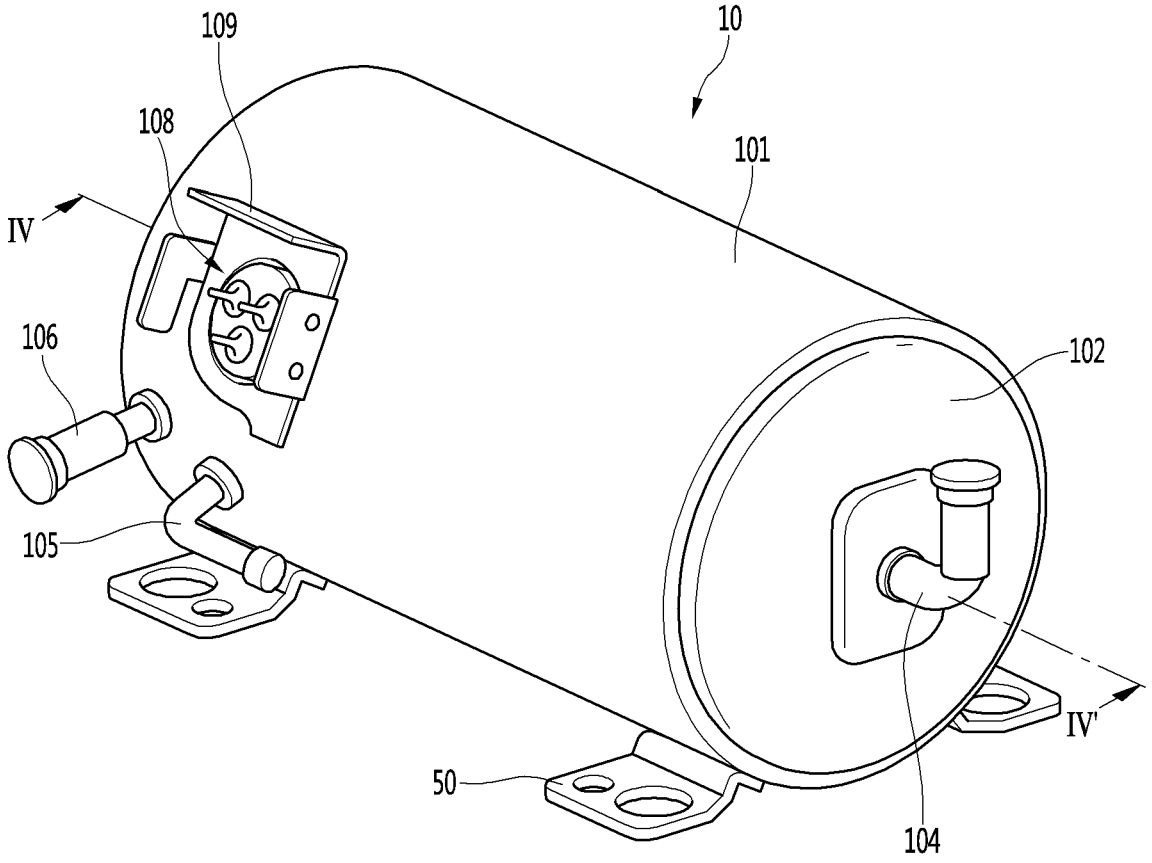
FIG. 1 is a diagram illustrating an example of a view showing a linear compressor according to an implementation of the present disclosure.
Figure 2:
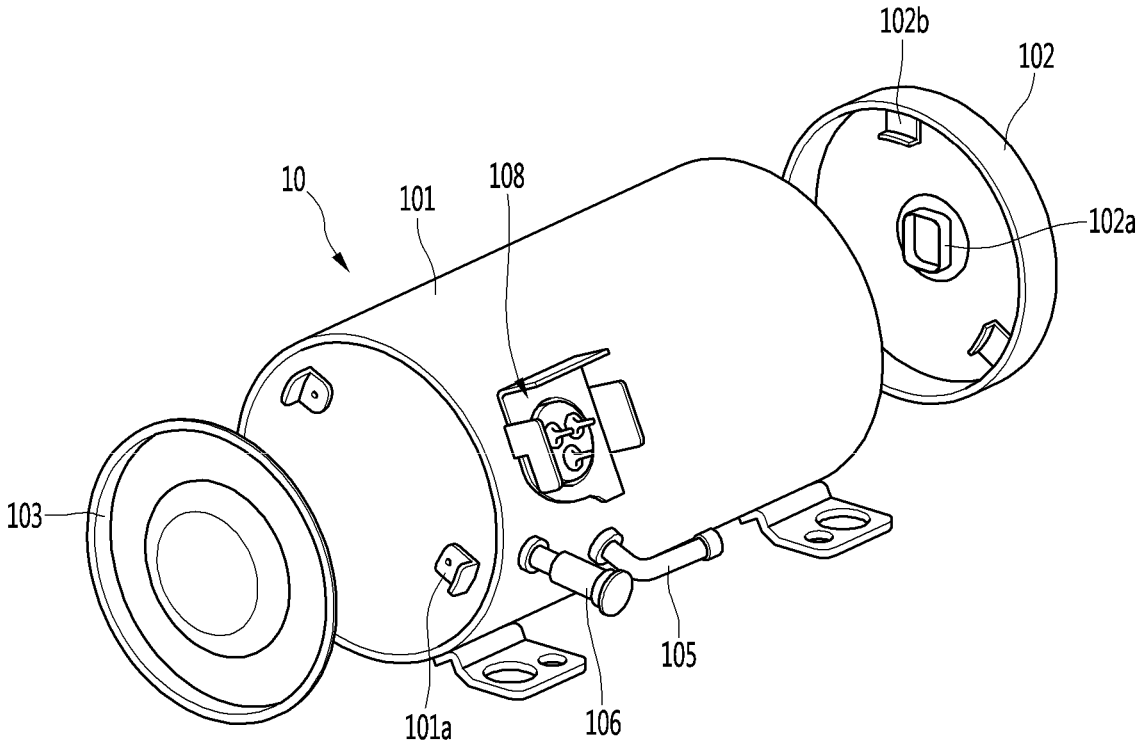
FIG. 2 is a diagram illustrating an example of a view showing the linear compressor according to an implementation with a shell and shell covers separated.

FIG. 1 is a diagram illustrating an example of a view showing a linear compressor according to an implementation of the present disclosure. FIG. 2 is a diagram illustrating an example of a view showing a linear compressor according to an implementation with a shell and shell covers separated.

As shown in the examples of FIGS. 1 and 2, a compressor 10, which may be a linear compressor, according to an implementation of the present disclosure includes a shell 101 and shell covers 102 and 103 combined with the shell 101. In a broad sense, the shell covers 102 and 103 may be understood as components of the shell 101.

Legs 50 may be coupled to the bottom of the shell 101. The legs 50 may be coupled to the base of a product on which the linear compressor 10 is installed. For example, the product may include a refrigerator and the base may include the base of the mechanical chamber of the refrigerator. Alternatively, the product may include the outdoor unit of an air-conditioning system and the base may include the base of the outdoor unit.

The shell 101 may have a substantially cylindrical shape and may be laid down horizontally or axially. On the basis of FIG. 1, the shell 101 may be horizontally elongated and may have a relatively small radial height. As an example, the linear compressor 10 may be small in height, so, for example, when the linear compressor 10 is disposed on the base of the mechanical chamber of a refrigerator, the height of the mechanical chamber can be reduced.

A terminal 108 may be disposed on the outer side of the shell 101. The terminal 108 is understood as a component that transmits external power to a motor assembly 140 (see FIG. 3) of the linear compressor. In particular, the terminal can be connected to a lead wire of a coil 141*c* (see FIG. 3).

A bracket 109 is disposed outside the terminal 108. The bracket 109 may include a plurality of brackets disposed around the terminal 108. The bracket 109 may perform a function of protecting the terminal 108 from external shock.

Both sides of the shell 101 are open. The shell covers 102 and 103 can be coupled to both open sides of the shell 101. In detail, the shell covers 102 and 103 include a first shell cover 102 coupled to one open side of the shell 101 and a second shell cover 103 coupled to the other open side of the shell 101. The internal space of the shell 101 can be sealed by the shell covers 102 and 103.

In the example of FIG. 1, the first shell cover 102 may be positioned at the right side of the linear compressor 10 and the second shell cover 103 may be positioned at the left side of the linear compressor 10. In other words, the first and second shell covers 102 and 103 may be arranged opposite each other.

The linear compressor 10 further includes a plurality of pipes 104, 105, and 106 disposed at the shell 101 or the shell covers 102 and 103 to suction, discharge, or inject a refrigerant.

The pipes 104, 105, and 106 include a suction pipe 104 for suctioning a refrigerant into the linear compressor 10, a discharge pipe 105 for discharging a compressed refrigerant out of the linear compressor 10, and a process pipe 106 for supplementing the linear compressor 10 with a refrigerant.

For example, the suction pipe 104 may be coupled to the first shell cover 102. A refrigerant can be suctioned into the linear compressor 10 axially through the suction pipe 104.

The discharge pipe 105 may be coupled to the outer side of the shell 101. The refrigerant suctioned through the suction pipe 104 can be compressed while axially flowing. The compressed refrigerant can be discharged through the discharge pipe 105. The discharge pipe 105 may be positioned closer to the second shell cover 103 than the first shell cover 102.

The process pipe 106 may be coupled to the outer side of the shell 101. A worker can inject a refrigerant into the linear compressor 10 through the process pipe 106.

The processor pipe 106 may be coupled to the shell 101 at a different height from the discharge pipe 105 to avoid interference with the discharge pipe 105. The height is understood as the vertical (or radial) distance from the legs 50. Since the discharge pipe 105 and the process pipe 105 are coupled at different heights to the outer side of the shell 101, work can be conveniently performed.

At least a portion of the second shell cover 103 may be positioned on the inner side of the shell 101, close to the position where the process pipe 106 is coupled. In other words, at least a portion of the second shell cover 103 can act as resistance against the refrigerant injected through the process pipe 106.

Accordingly, in terms of a channel for a refrigerant, the size of the channel for the refrigerant that flows inside through the processor pipe 106 is decreased by the second shell cover 103 when entering the shell 101 and then increased through the shell 101. While a refrigerant flows through the channel, it may evaporate due to a drop of pressure, and in this process, oil contained in the refrigerant can be separated. Accordingly, the refrigerant without oil separated flows into a piston 130 (see FIG. 3), so the performance of compressing a refrigerant can be improved. The oil may be understood as a working oil existing in a cooling system.

A cover supporting portion 102*a* is formed on the inner side of the first shell cover 102. A second retainer 185 to be described below may be coupled to the cover supporting portion 102*a*. The cover supporting portion 102*a* and the second retainer 185 may be understood as a mechanism that supports the body of the linear compressor 10. The body of the compressor may include a part disposed in the shell 101, and for example, it may include an operation mechanism that reciprocates forward and backward and a supporting mechanism that supports the operation mechanism.

The operation mechanism may include a piston 130, a magnet 146, a supporter 137, and a muffler 150, which will be described below. The supporting mechanism may include resonance springs 176*a* and 176*b*, a rear cover 170, a stator cover 149, a first retainer 165, and a second retainer 185, which will be described below.

Stoppers 102*b* may be formed on the inner side of the first shell cover 102. The stoppers 102*b* are understood as parts that prevent the body of the compressor, particularly, the motor assembly 140 from being damage by hitting against the shell 101 due to vibration or shock that is generated while the linear compressor 10 is carried. The stoppers 102*b* are positioned close to the rear cover 170 to be described below, so when the linear compressor 10 is shaken, the rear cover 170 is held by the stoppers 102*b*, thereby preventing shock from being transmitted to the motor assembly 140.

Spring couplers 101*a* may be disposed on the inner side of the shell 101. For example, the spring couplers 101*a* may be positioned close to the second shell cover 103. The spring couplers 101*a* may be coupled to a second supporting spring 186 of the first retainer 165. Since the spring couplers 101*a* and the first retainer 165 are coupled to each other, the body of the compressor can be stably supported in the shell 101.

Figure 3:
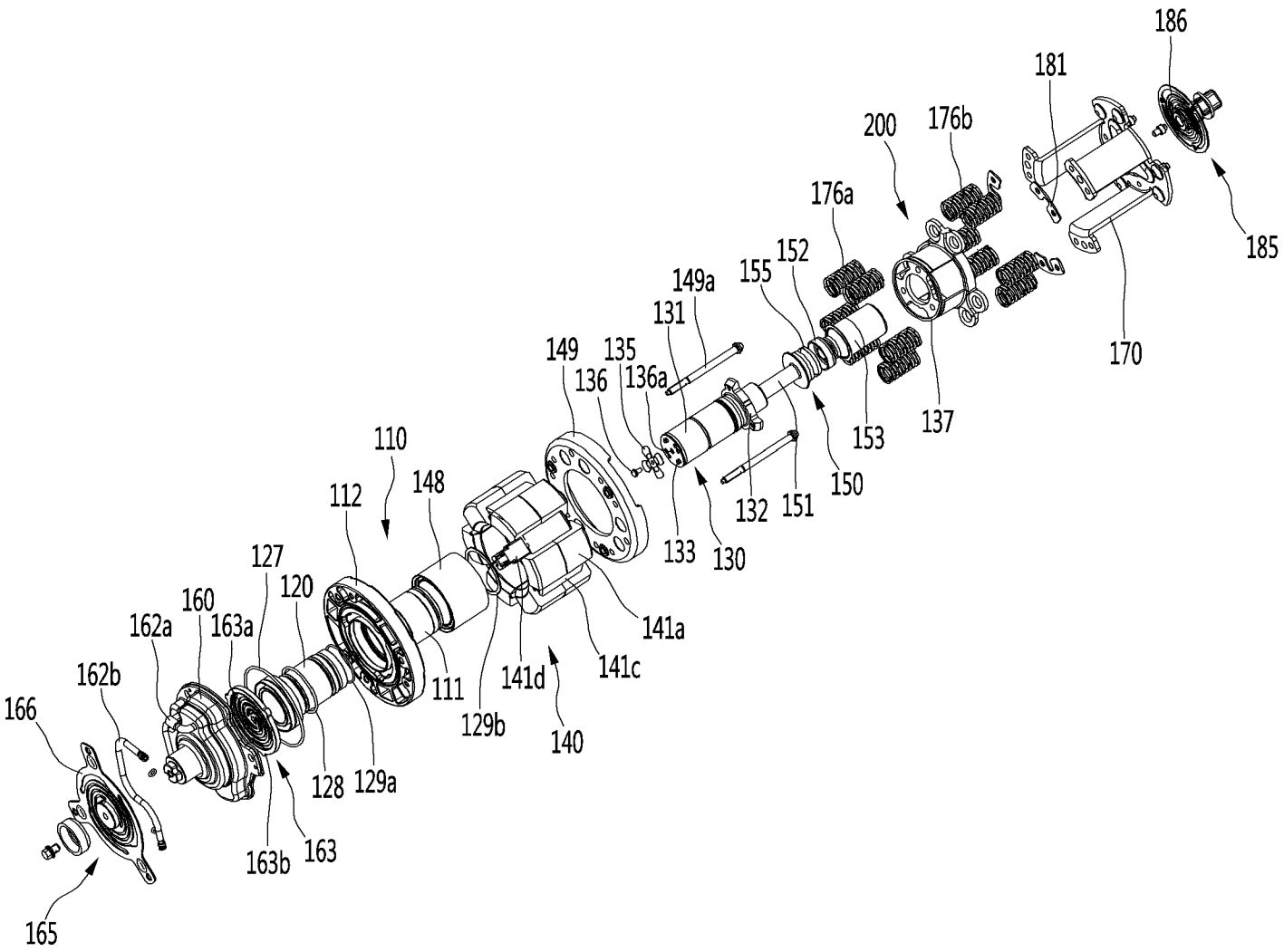
FIG. 3 is a diagram illustrating an example of an exploded view showing the components in the linear compressor according to an implementation of the present disclosure.

FIG. 3 is a diagram illustrating an example of an exploded view showing components in a linear compressor according to an implementation of the present disclosure.

Figure 4:
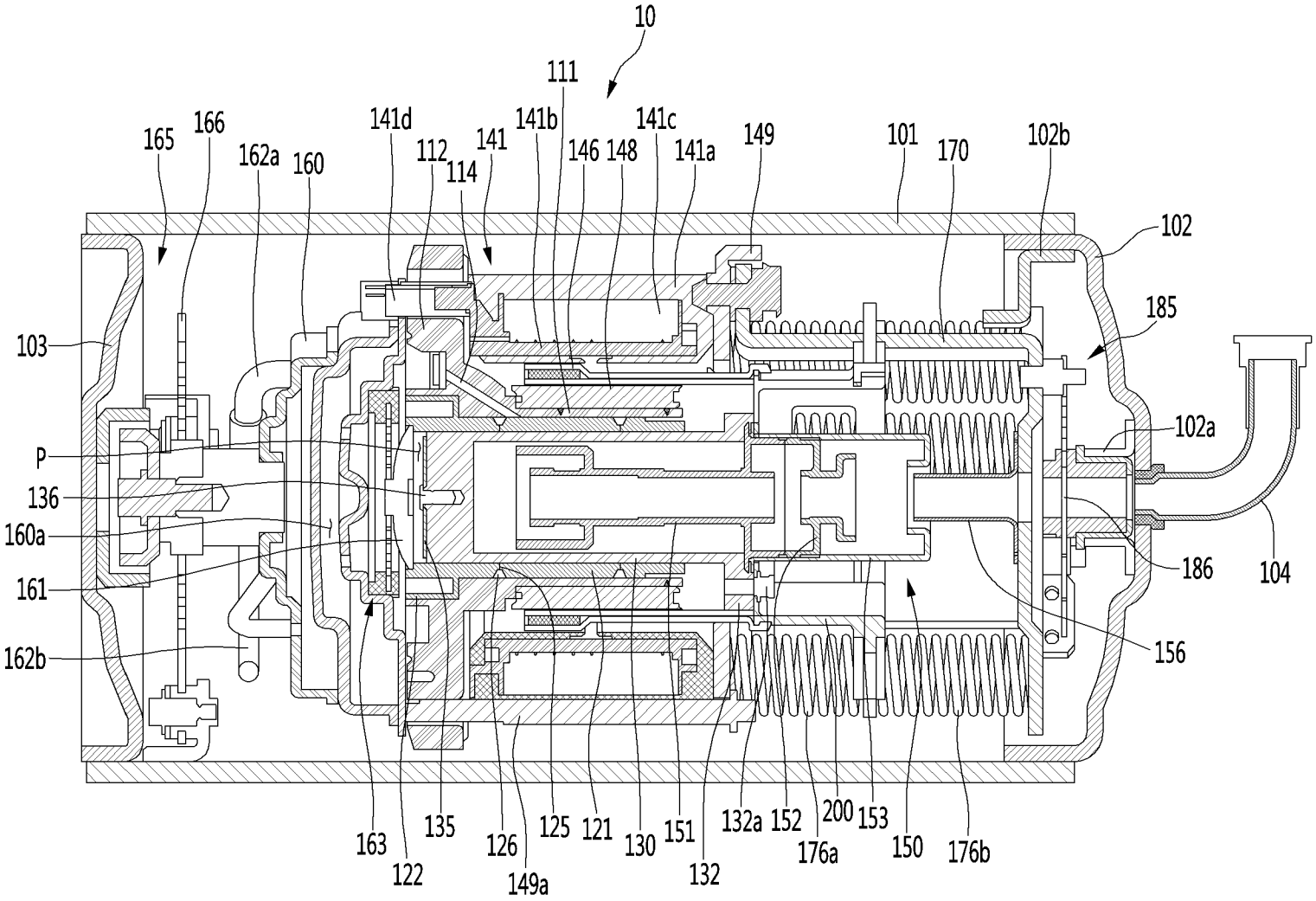
FIG. 4 is a diagram illustrating an example of a cross-sectional view taken along line IV-IV' of FIG. 1.

FIG. 4 is a diagram illustrating an example of a cross-sectional view taken along line IV-IV' of FIG. 1.

Referring to the examples of FIGS. 3 and 4, the linear compressor 10 according to an implementation of the present disclosure includes the cylinder 120 disposed in the shell 101, the piston 130 reciprocating straight in the cylinder 120, and the motor assembly 140 that is a linear motor providing a driving force to the piston 130. When the motor assembly 140 is operated, the piston 130 can be axially reciprocated.

The linear compressor 10 further includes a suction muffler 150 combined with the piston 130 to reduce noise that is generated by the refrigerant suctioned through the suction pipe 104. The refrigerant suctioned through the suction pipe 104 flows into the piston 130 through the suction muffler 150. For example, the flow noise of the refrigerant can be reduced while the refrigerant flows through the suction muffler 150.

The suction muffler 150 includes a plurality of mufflers 151, 152, and 153. The mufflers include a first muffler 151, a second muffler 152, and a third muffler 153 that are assembled together.

The first muffler 151 is disposed in the piston 130 and the second muffler 152 is coupled to the rear end of the first muffler 151. The third muffler 153 receives the second muffler 152 and may extend rearward from the first muffler 151. In respect of the flow direction of a refrigerant, the refrigerant suctioned through the suction pipe 104 can sequentially flow through the third muffler 153, the second muffler 152, and the first muffler 151. The flow noise of the refrigerant can be reduced in this process.

The suction muffler 150 may further include a muffler filter 155. The muffler filter 155 may be disposed at the interface between the first muffler 151 and the second muffler 152. For example, the muffler filter 155 may have a circular shape and the outer side of the muffler filter 155 can be supported between the first and second mufflers 151 and 152.

Directions are defined as follows.

The term "axial direction" may be understood as the reciprocation direction of the piston 130, that is, the horizontal direction in FIG. 4. In the "axial direction", the direction going toward the compression space P from the suction pipe 104, that is, the flow direction of a refrigerant is defined as a "forward direction" and the opposite direction is defined as a "rear direction" When the piston 130 is moved forward, the compression space P can be compressed.

In some scenarios, the term "radial direction", which is the direction perpendicular to the reciprocation direction of the piston 130, may refer to the vertical direction in FIG. 4.

The piston 130 include a substantially cylindrical piston body 131 and a piston flange 132 radially extending from the piston body 131. The piston body 131 can reciprocate in the cylinder 120 and the piston flange 132 can reciprocate outside the cylinder 120.

The cylinder 120 includes a cylinder body 121 axially extending and a cylinder flange 122 formed on the outer side of the front portion of the cylinder body 121. At least a portion of the first muffler 151 and at least a portion of the piston body 131 are received in the cylinder 120.

A gas inlet 126 through which at least some of the refrigerant discharged through a discharge valve 161 flows inside is formed at the cylinder body 121. The gas inlet 126 may be radially recessed from the outer side of the cylinder body 121.

The gas inlet 126 may be circumferentially formed around the outer side of the cylinder body 121 about the central axis. A plurality of gas inlets 126 may be provided. For example, two gas inlets 126 may be provided.

The cylinder body 121 includes a cylinder nozzle 125 extending radially inward from the gas inlet 126. The cylinder nozzle 125 may extend to the inner side of the cylinder body 121. The refrigerant flowing inside through the gas inlet 126 and the cylinder nozzle 125 may be understood as a refrigerant that is used as a gas bearing between the piston 130 and the cylinder 120.

The compression space P in which a refrigerant is compressed by the piston 130 is defined in the cylinder 120. Suction holes 133 allowing for a refrigerant to flow into the compression space P are formed at the front side of the piston body 131 and a suction valve 135 for selectively opening the suction hole 133 is disposed ahead of the suction holes 133.

Further, a fastening hole 136*a* to which a predetermined fastener 136 is fastened is formed at the front side of the piston body 131. In detail, the fastening hole 136*a* is positioned at the center of the front side of the piston body 131 and the suction holes 133 are arranged around the fastening hole 136*a*. The fastener 136 is inserted in the fastening hole 136*a* through the suction valve 135, thereby fixing the suction valve 135 to the front side of the piston body 131.

In some implementations, a discharge cover and a discharge valve assembly are disposed ahead of the compression space P. For example, the discharge cover 160 defines a discharge space 160*a* for the refrigerant that is discharged from the compression space P. The discharge valve assembly is coupled to the discharge cover 160 and is configured to selectively discharge the refrigerant compressed in the compression space P. The discharge space 160*a* includes a plurality of sections divided by the inner side of the discharge cover 160. The sections are arranged in the front-rear direction and can communicate with each other.

The discharge valve assembly includes a discharge valve 161 that allows a refrigerant to flow into the discharge space 160*a* of the discharge cover 160 by opening when the pressure in the compression space P becomes a discharge pressure or more. The discharge valve assembly also includes a spring assembly 163 that is disposed between the discharge valve 161 and the discharge cover 160 and axially provides elasticity.

The spring assembly 163 includes a valve spring 163*a* and a spring supporting portion 163*b* for supporting the valve spring 163*a* to the discharge cover 160. For example, the valve spring 163*a* may include a plate spring. The spring supporting portion 163*b* may be integrally formed with the valve spring 163*a* by injection molding.

The discharge valve 161 is coupled to the valve spring 163*a* and the rear portion or the rear side of the discharge valve 161 is disposed to be able to be supported by the front side of the cylinder 120. When the discharge valve 161 is in contact with the front side of the cylinder 120, the compression space P is maintained in a sealing state, and when the discharge valve 161 is spaced from the front side of the cylinder 120, the compression space P is opened and the compressed refrigerant in the compression space P can be discharged.

Accordingly, in some implementations, the compression space P may be a space that is defined between the suction valve 135 and the discharge valve 161. The suction valve 135 may be formed at a side of the compression space P, and the discharge valve 161 may be disposed at the other side of the compression space P (e.g., opposite the suction valve 135).

When the pressure in the compression space P decreases to a suction pressure or less, and is lower than a discharge pressure while the piston 130 reciprocates in the cylinder 120, then the suction valve 135 is opened and a refrigerant is suctioned into the compression space P. However, when the pressure in the compression space P increases to the suction pressure or more, then the refrigerant in the compression space P is compressed with the suction valve 135 closed.

When the pressure in the compression space P increases to the discharge pressure or more, then the valve spring 163*a* opens the discharge valve 161 by deforming forward and a refrigerant is discharged from the compression space P into the discharge space 160*a*. When the refrigerant finishes being discharged, then the valve spring 163*a* provides a restoring force to the discharge valve 161, so that the discharge valve 161 is closed.

In some implementations, the linear compressor 10 further includes a cover pipe 162*a* coupled to the discharge cover 160 to discharge the refrigerant flowing through the discharge space 160*a* of the discharge cover 160. For example, the cover pipe 162*a* may be made of metal.

The linear compressor 10 further includes a loop pipe 162*b* coupled to the cover pipe 162*a* to transmit the refrigerant flowing through the cover pipe 162*a* to the discharge pipe 105. The loop pipe 612*b* may be coupled to the cover pipe 162*a* at a side and to the discharge pipe 105 at the other side.

In some implementations, the loop pipe 162*b* is made of a flexible material and may have a relatively large length. The loop pipe 162*b* may be rounded along the inner side of the shell 101 from the cover pipe 162*a* and coupled to the discharge pipe 105. For example, the loop pipe 162*b* may be wound.

The linear compressor 10 further includes a frame 110. The frame 110 is component for fixing the cylinder 120. For example, the cylinder 120 may be forcibly fitted in the frame 110. The cylinder 120 and the frame 110 may be made of aluminum or an aluminum alloy.

The frame 110 includes a substantially cylindrical frame body 111 and a frame flange 112 radially extending from the frame body 111. The frame body 111 is disposed to surround the cylinder 120. That is, the cylinder 120 may be received in the frame body 111. The frame flange 112 may be coupled to the discharge cover 160.

A gas hole 114 allowing at least some of the refrigerant discharged through the discharge valve 161 to flow to the gas inlet 126 is formed at the frame 110. The gas hole 114 connects the frame flange 112 and the frame body 111 to each other.

The motor assembly 140 includes an outer stator 141, an inner stator 148 spaced inward from the outer stator 141, and a magnet 146 disposed in the space between the outer stator 141 and the inner stator 148.

The magnet 146 can be reciprocated straight by a mutual electromagnetic force with the outer stator 141 and the inner stator 148. The magnet 146 may be a single magnet having one pole or may be formed by combining a plurality of magnets having three poles.

The inner stator 148 is fixed to the outer side of the frame body 111. The inner stator 148 is formed by stacking a plurality of laminations radially outside the frame body 111.

The outer stator 141 includes a coil assembly and a stator core 141*a*. The coil assembly includes a bobbin 141*b* and a coil 141*c* that is circumferentially wound around the bobbin 141*b*.

The coil assembly further includes a terminal 141*d* leading or exposing a power line connected to the coil 141*c* to the outside of the outer stator 141. The terminal 141*d* may extend through the frame flange 112.

The stator core 141*a* includes a plurality of core blocks formed by circumferentially stacking a plurality of laminations. The core blocks may be arranged around at least a portion of the coil assembly.

A stator cover 149 is disposed at a side of the outer stator 141. In the outer stator 141, a side may be supported by the frame flange 112 and the other side may be supported by the stator cover 149. Consequently, the frame flange 112, the outer stator 141, and the stator cover 149 are sequentially disposed in the axial direction.

The linear compressor 10 further includes cover fasteners 149*a* for fastening the stator cover 149 and the frame flange 112. The cover fasteners 149*a* may extend forward toward the frame flange 112 through the stator cover 149 and may be coupled to the frame flange 112.

The linear compressor 10 further includes a rear cover 170 coupled to the stator cover 149, extending rearward, and supported by the second retainer 185.

In detail, the rear cover 170 has three supporting legs and the three supporting legs may be coupled to the rear side of the stator cover 149. A spacer 181 may be disposed between the three supporting legs and the rear side of the stator cover 149. It is possible to determine the distance from the stator cover 149 to the rear end of the rear cover 170 by adjusting the thickness of the spacer 181.

The linear compressor 10 further includes an intake guide 156 coupled to the rear cover 170 to guide a refrigerant into the suction muffler 150. The intake guide 156 may be at least partially inserted in the suction muffler 150.

The linear compressor 10 further includes a plurality of resonance springs 176*a* and 176*b* of which the natural frequencies are adjusted such that the piston 130 can be resonated. By the resonance springs 176*a* and 176*b*, the operation mechanism that reciprocates in the linear compressor 10 can be stably operated and vibration or noise by movement of the operation mechanism can be reduced.

The linear compressor 10 further includes the first retainer 165 coupled to the discharge cover 160 and supporting a side of the body of the compressor 10. The first retainer 165 is disposed close to the second shell cover 103 and can elastically support the body of the compressor 10. In detail, the first retainer 165 includes a first supporting spring 166. The first supporting spring 166 may be coupled to the spring couplers 101*a*.

The linear compressor 10 further includes the second retainer 185 coupled to the rear cover 170 and supporting the other side of the body of the compressor 10. The second retainer 185 is coupled to the first shell cover 102 and can elastically support the body of the compressor 10. In detail, the second retainer 185 includes a second supporting spring 186. The second supporting spring 186 may be coupled to the cover supporting portion 102*a*.

In some implementations, the linear compressor 10 further includes a plurality of seals for more firmly combining the frame 110 and the components around the frame 110. For example, the seals may have a ring shape.

As a detailed example, the seals may include a first seal 127 disposed at the joint between the frame 110 and the discharge cover 160. The seals further includes second and third seals 128 and 129*a* disposed at the joint between the frame 110 and the cylinder 120 and a fourth seal 129*b* disposed at the joint between the frame 110 and the inner stator 148.

The linear compressor 10 includes a magnet unit 200 in which the magnet 146 is disposed. The magnet unit 200 is disposed to support the piston 130. An example of the magnet unit 200 is described in detail hereafter.

Figure 5:
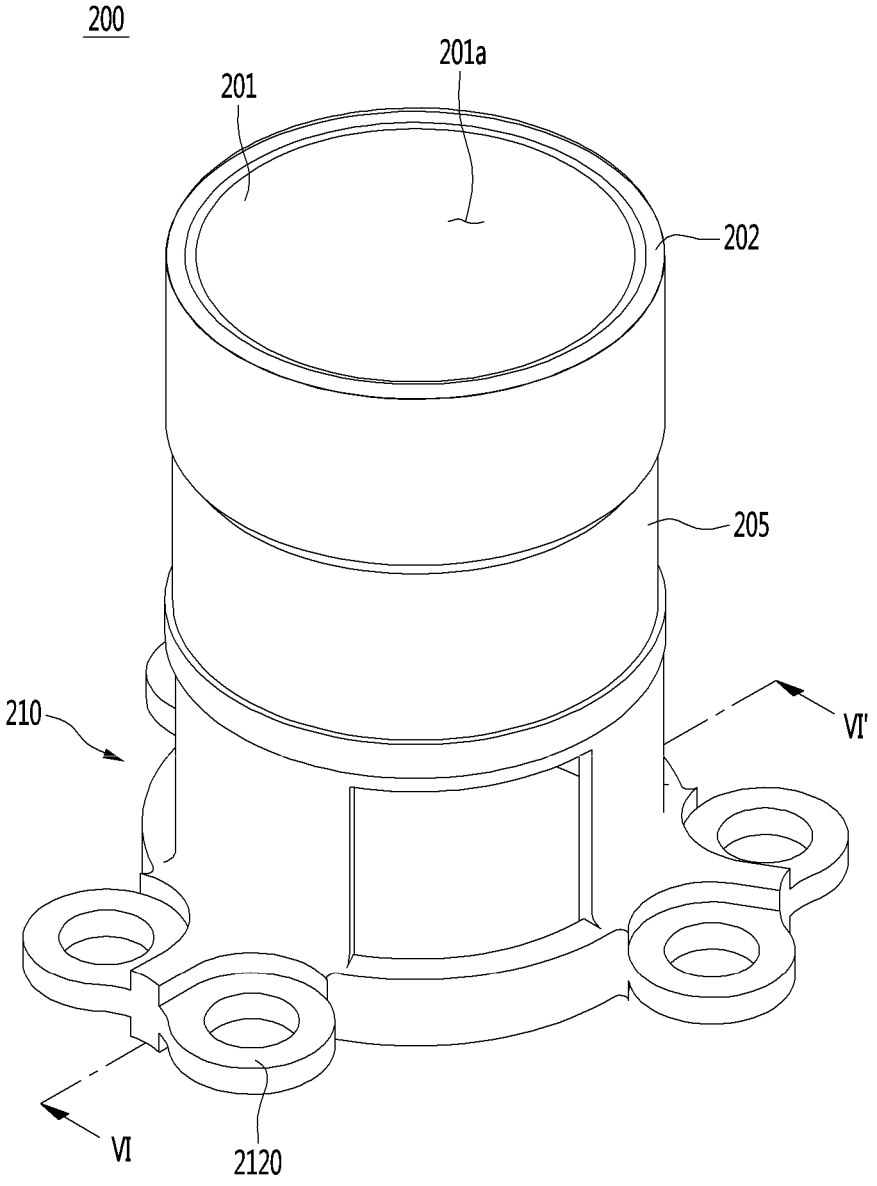
FIG. 5 is a diagram illustrating an example of a view showing a magnet unit of the linear compressor according to an implementation of the present disclosure.
Figure 6:
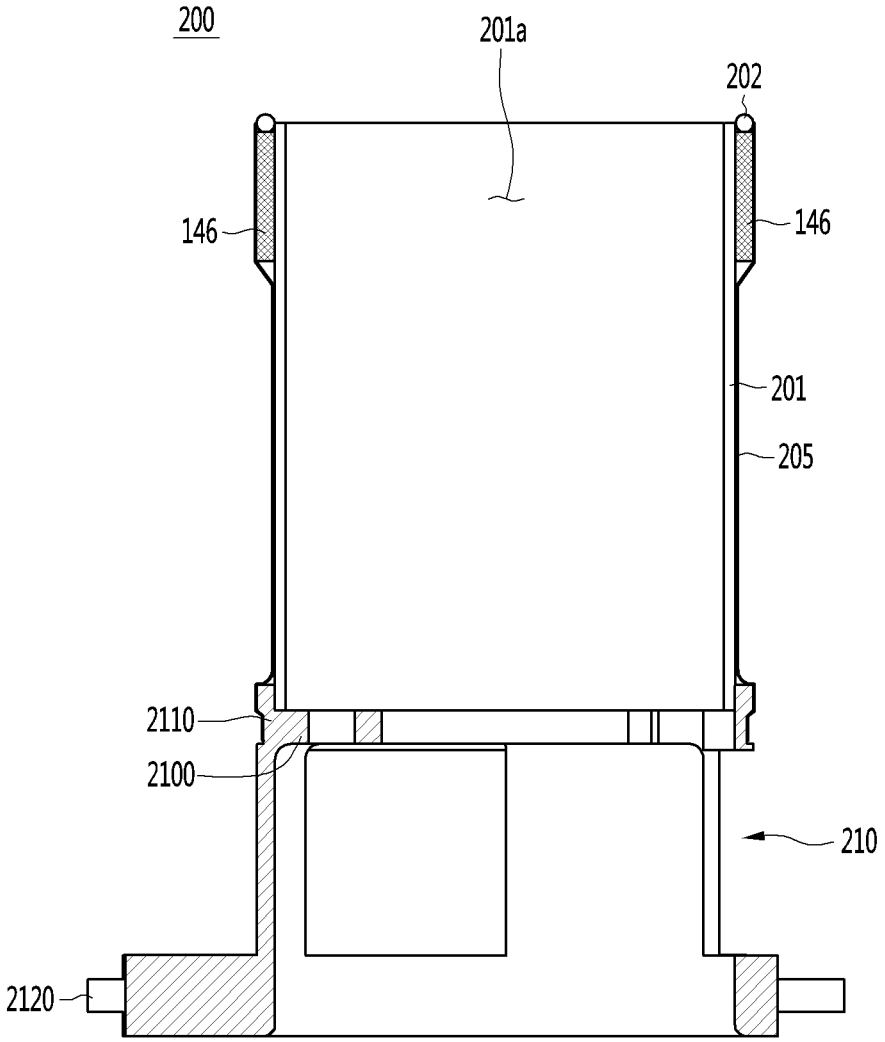
FIG. 6 is a diagram illustrating an example of a cross-sectional view taken along line VI-VI' of FIG. 5.

FIG. 5 is a diagram illustrating an example of an exploded view of a magnet unit of a linear compressor according to an implementation of the present disclosure and FIG. 6 is a diagram of an example of a cross-sectional view taken along line VI-VI' of FIG. 4.

As shown in the examples of FIGS. 5 and 6, the magnet unit 200 includes a plurality of magnets 146 and a magnet frame 201 holding the magnet 146. The magnet frame 201 may be formed in a cylindrical shape and the magnets 146 may be attached to the outer side of the magnet frame 201.

As a detailed example, the magnet frame 201 is formed in an axially hollow cylindrical shape and has a receiving space 201*a* therein for receiving the frame body 111 and the inner stator 148 coupled to the frame body 111. For example, the magnet frame 201 has a radius larger than that of the inner stator 148.

The magnets 146 may be disposed at the front portion in the axial direction of the magnet frame 201. The magnets 146 may be circumferentially arranged on the outer side of the magnet frame 201.

The magnet unit 200 further includes a magnet-fixing ring 202 for fixing the magnets 146. The magnet fixing ring 202 may be formed in a ring shape fitted on the outer side of the magnet frame 201. Referring to FIG. 6, the magnet-fixing ring 202 may be disposed at the front end of the magnet frame 201 in contact with a side of each of the magnets 146.

The magnet unit 200 further includes a magnet-fixing member 205 surrounding the outer side of the magnet frame 201. In particular, the magnet-fixing member 205 is combined with the magnet frame 201 to surround the magnets 146 and the magnet-fixing ring 202.

For example, the magnet-fixing member 206 may be an adhesive having a predetermined adhesive force. Accordingly, by bonding the magnet-fixing member 206 to the magnet frame 201 to surround the magnets 146 and the magnet-fixing ring 202, the magnets 146 and the magnet-fixing ring 202 can be fixed.

The magnet unit 200 further includes an all-in-one supporter 210 (e.g., as part or whole of supporter 137 in FIG. 2). In some implementations, the all-in-one supporter 210 is manufactured by aluminum die casting. The all-in-one supporter 210 may be formed in various integrated shapes, hence being referred to as an "all-in-one" supporter. However, the term "all-in-one" when used in this context is not limited to a particular combination of components, and instead generally refers to an integrated nature of the supporter 137.

In the example of FIGS. 5 and 6, the all-in-one supporter 210 has a piston coupler 2100, a magnet coupler 2110, and a spring coupler 2120. In some implementations, the all-in-one supporter 210 may be a component that is combined (e.g., coupled) with the piston 130, the magnets 146, and the resonance springs 176*a* and 176*b*.

Figure 7:
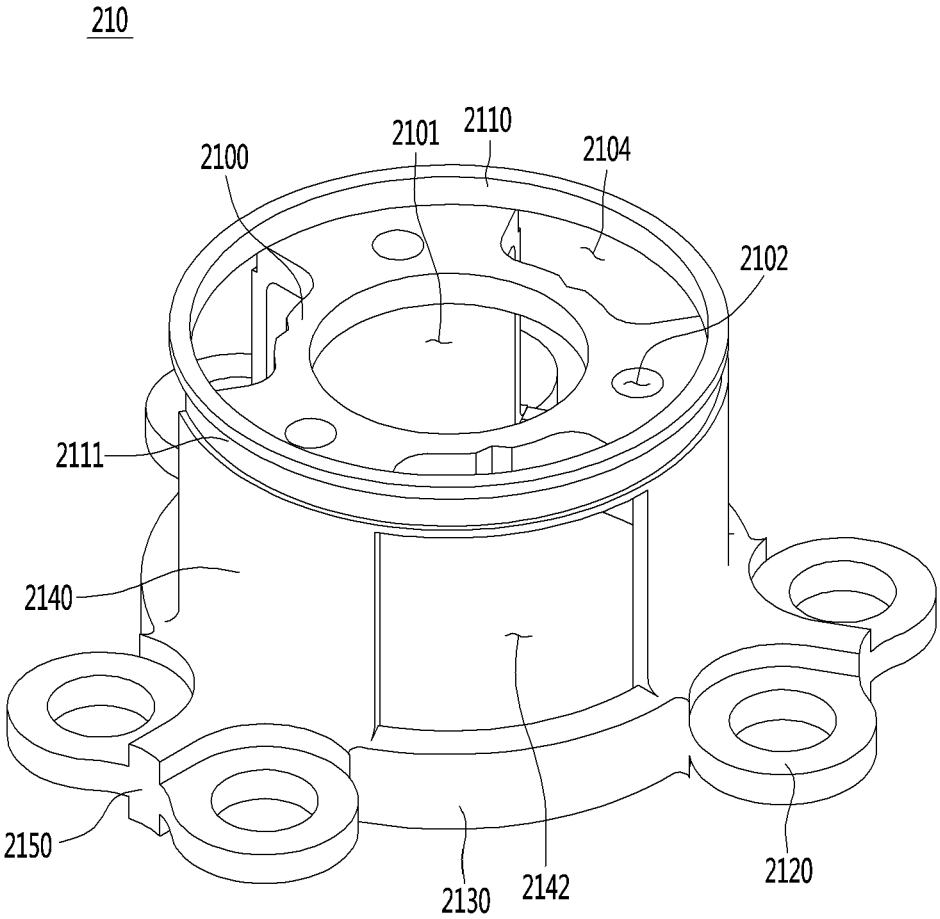
FIGS. 7 to 9 are diagrams illustrating examples of views showing an all-in-one supporter of the linear compressor according to an implementation of the present disclosure.
Figure 8:
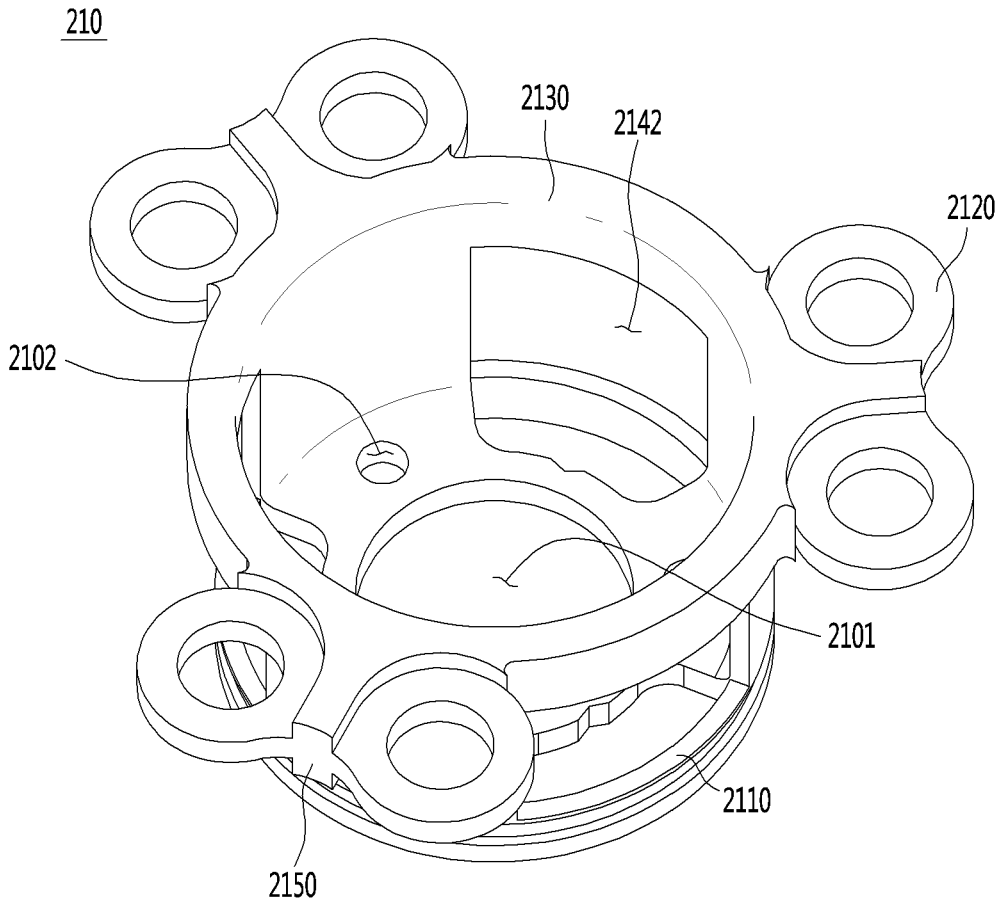
Figure 9:
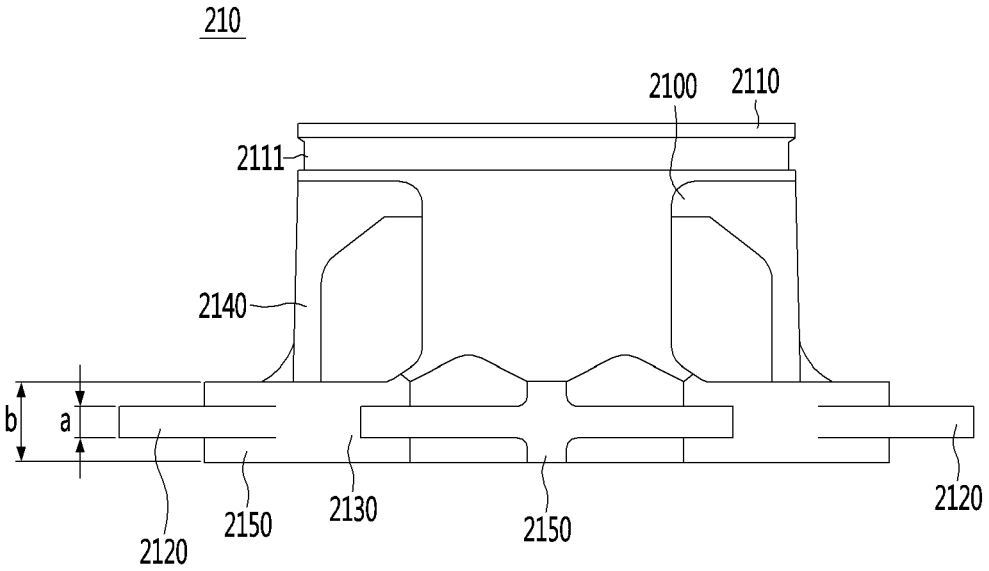

FIGS. 7 to 9 are diagrams showing examples of an all-in-one supporter of a linear compressor according to an implementation of the present disclosure.

As shown in the examples of FIGS. 7 to 9, in some implementations, the all-in-one supporter 210 may be a single unit. However, for convenience of description herein, the piston coupler 2100, magnet coupler 2110, and spring coupler 2120 will be described separately.

The piston coupler 2100 is formed in a circular flat plate shape radially extending. The radius of the piston coupler 2100 may correspond to the maximum radius of the piston flange 132.

The piston coupler 2100 has a muffler hole 2101 for fitting the suction muffler 150 and piston holes 2102 for coupling the piston flange 132. The muffler hole 2101 may have a size corresponding to the outer side of the suction muffler 150.

In detail, the muffler hole 2101 is formed at the center of the piston coupler 2100 and the piston holes 2102 are formed radially outside the muffler hole 2101. For example, three piston holes 2102 may be provided and arranged with intervals of 120 degrees around the muffler hole 2101.

The linear compressor 10 further includes piston fasteners 132*a* (see FIG. 4) for fastening the piston flange 132 and the all-in-one supporter 210. The cover fasteners 132*a* are inserted in the piston holes 2102 and, in some implementations, holes may be formed at the piston flange 132 to correspond to the piston holes 2102.

Piston-cut portions 2104 are formed between the piston holes 2102 through the piston coupler 2100. In detail, the piston-cut portions 2104 may include cut portions that are configured to reduce the weight of the piston coupler 2100.

In the related art, the piston-cut portions 2104 had various shapes and holes for coupling and arranging other components. However, since the all-in-one supporter 210 is a single unit, such structure is not needed and the piston-cut portions 2104 can be formed in a relatively simple shape. In particular, the piston-cut portions 2104 may be formed larger to reduce the weight.

Since the all-in-one supporter 210 is formed by aluminum die casting, the piston coupler 2100 can be formed in various shapes. Accordingly, it is possible to effectively reduce the weight by cutting off unnecessary portions.

Referring to the example of FIG. 8, the portions where the piston-cut portions 2104 are formed around the edge may be formed relatively thick. This may provide additional strength to compensate for the cut-off portions. For example, in scenarios where the all-in-one supporter 210 is formed by aluminum die casting, the thickness maybe different.

The magnet coupler 2110 is formed in a ring shape axially extending forward from the outer side of the piston coupler 2100. The inner side of the magnet coupler 2110 has a size corresponding to the outer side of the magnet frame 201. Accordingly, as shown in the example of FIG. 6, the rear end of the magnet frame 201 can be received in the magnet coupler 2110.

In some implementations, a magnet seat 2111 recessed radially inward is formed on the outer side of the magnet coupler 2110. The magnet seat 2111 may be a part formed so that the magnet-fixing member 205 can be coupled in closer contact with the magnet coupler 2110.

A combination of the all-in-one supporter 210 and the magnets 146 is described with reference to the example of FIG. 6. In this example, the rear end of the magnet frame 201 is received in the magnet coupler 2110. The rear end of the magnet frame 201 can be axially seated on the piston coupler 2100.

The magnets 146 and the magnet-fixing ring 202 are attached to the outer side of the magnet frame 201. The magnet-fixing member 205 is coupled to the outer side of the magnet frame 201 and the outer side of the magnet coupler 2110.

For example, the magnet frame 201 is disposed radially inside the magnet coupler 2110 and the magnet-fixing member 205 is disposed radially outside the magnet coupler 2110. Accordingly, the magnets 146 and the magnet frame 201 can be fixed to the all-in-one supporter 210. This assembly is the magnet unit 200 described above.

The spring coupler 2120 is formed in a circular flat plate shape radially extending. The spring coupler 2120 is disposed radially further outside than the magnet coupler 2110 and the piston coupler 2100. The spring coupler 2120 may have a size corresponding to the resonance springs 176*a* and 176*b* to support the resonance springs 176*a* and 176*b*.

The resonance springs include first resonance springs 176*a* disposed axially ahead of the spring coupler 2120 and second resonance springs 176*b* disposed axially behind the spring coupler 2120. That is, the spring coupler 2120 is disposed axially between the first resonance springs 176*a* and the second resonance springs 176*b*.

The first resonance springs 176*a* are disposed axially between the spring coupler 2120 and the stator cover 149 and the second resonance springs 176*b* are disposed axially disposed between the spring coupler 2120 and the rear cover 170. Consequently, the stator cover 149, first resonance springs 176*a*, spring coupler 2120, second resonance springs 176*b*, and rear cover 170 are axially sequentially arranged.

The first and second resonance springs 176*a* and 176*b* may be each circumferentially spaced from each other. For example, the first and second resonance springs 176*a* and 176*b* may be respectively six pieces and pairs of each of the first and second resonance springs are circumferentially arranged with intervals of 120 degrees. Further, the spring couplers 2120 may be six pieces and pairs may be circumferentially arranged with intervals of 120 degrees.

The all-in-one supporter 210 has bridges 2130 and 2140 connecting the piston coupler 2100, the magnet coupler 2110, and the spring coupler 2120.

The bridges 2130 and 2140 include spring bridges 2130 connecting the spring couplers 2120 and body bridges 2140 connecting the spring bridges 2130, the piston coupler 2100, and the magnet coupler 2110.

The spring bridges 2130 are formed in a ring shape connecting the spring couplers 2120 circumferentially spaced from each other. The spring bridges 2130 have a size corresponding to the magnet coupler 2110 and may be arranged axially in parallel with each other.

The body bridges 2140 axially extend to connect the spring bridges 2130 and the magnet coupler 2110 that are axially spaced from each other. For example, the magnet coupler 2110, the body bridges 2140, and the spring bridges 2130 axially extend. Further, in some implementations, the magnet coupler 2110, the body bridges 2140, and the spring bridges 2130 may have an entirely cylindrical shape.

The piston coupler 2100 is disposed radially inward at the upper end of the body bridges 2140. For example, the magnet coupler 2110 axially extends upward from the upper ends of the body bridges 2140, the piston coupler 2100 extends radially inward from the upper ends of the body bridges 2140, and the spring bridges 2130 extend axially downward from the lower ends of the body bridges 2140.

Body-cut portions 2142 are formed at the body bridges 2140. As a detailed example, the body-cut portions 2142 can function as passage for smooth flow of a refrigerant. Accordingly, the larger the body-cut portions 2142, the smoother the refrigerant can flow.

In particular, since the all-in-one supporter 210 is manufactured by aluminum die casting, the body-cut portions 2142 can be formed in desired sizes. That is, the body-cut portions 2142 may be formed smaller in comparison to those in the related art. The reduction of strength by the body-cut portions 2142 can be compensated by the thickness of the portions close to the body-cut portions 2142.

The body-cut portions 2142 may be formed in various shapes. For example, the body-cut portions 2142 may be formed in the same area as the body bridges 2140 and spaced circumferentially with intervals of 120 degrees. That is, the weight of the body bridges 2140 can be reduced a half by the body-cut portions 2142.

Accordingly, the body bridges 2140 may be formed in column shapes spaced circumferentially with intervals of 120 degrees. In some implementations, the cross-sections of the body bridges 2140 may have arc shapes.

The bridges 2130 and 2140 includes assistant bridges 2150 extending radially outward from the spring bridges 2130 and coupled to the spring couplers 2120.

As a detailed example, the spring couplers 2120 extend radially outward from the spring bridges 2130. Further, as described above, the spring couplers 2120 are provided in pairs and the assistant bridges 2150 each connect a pair of spring bridges 2130.

For example, the pairs of spring couplers 2120 disposed circumferentially close to each other are respectively connected by the assistant bridges 2150 and the spring couplers 2120 circumferentially spaced from each other are connected by the spring bridges 2130. That is, the assistant bridges 2150 may be at least portions of the spring bridges 2130.

The assistant bridges 2150 and the spring bridges 2130 may be formed axially longer than the spring couplers 2120. For example, the assistant bridges 2150 and the spring bridges 2130 may be formed thicker than the spring couplers 2120.

Referring to the example of FIG. 9, the axial length, that is, the thickness of the spring bridges 2130, corresponds to 'a' and furthermore, the axial length, that is, the thickness of the assistant bridges 2150, corresponds to 'b'. In this example, b is larger than a (i.e., b>a) and b may be two times a (b=2a). However, these are merely examples and b may be of various values larger than a.

Such implementations may address a stress level that concentrates on the assistant bridges 2150 by movement of the first and second resonance springs 176*a* and 176*b*. As such, some implementations may help prevent damage by increasing the thickness of the portions on which stress concentrates.

In some implementations, the shape of the all-in-one supporter 210 may be achieved by having the all-in-one supporter 210 manufactured by aluminum die casting. Such implementations may reduce the weight and maintain the strength by freely changing the shape.

Further, in some implementations, the all-in-one supporter 210 is a part that reciprocates with the magnets 146 and the piston 130. Accordingly, as the weight is reduced, the all-in-one supporter 210 can more efficiently reciprocate and the linear compressor 10 according to an aspect of the present disclosure can be operated at a higher operation frequency.

According to implementations of the present disclosure, it is possible to freely change the shape by manufacturing the all-in-one supporter combined with the magnets, piston, and resonance springs through aluminum die casting.

In particular, it is possible to reduce the weight while maintaining the strength of the all-in-one supporter, and as the weight is reduced, the all-in-one supporter can more efficiently reciprocate.

In addition, since the weight of the operation mechanism including the all-in-one supporter is reduced, the linear compressor can be operated at a higher operation frequency.

Further, since the all-in-one supporter is combined with various components and performs various functions, the coupling structure is reduced, so the manufacturing time and coupling members are reduced, and accordingly, the manufacturing cost is reduced.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a piston configured to reciprocate along an axial direction of the linear compressor, the piston comprising:

a piston body having a cylindrical shape and extending in the axial direction, and a piston flange extending in a radial direction from the piston body;

a resonance spring configured to elastically support the piston along the axial direction;

a motor assembly configured to provide a driving force to the piston, the motor assembly comprising a magnet that is disposed radially outside the piston body;

a magnet frame having a cylindrical shape that extends in the axial direction, the magnet frame being disposed radially outside the piston body and surrounding the piston body, and the magnet being attached to an outer side of the magnet frame; and a supporter configured to be coupled to the piston, the magnet, and the resonance spring, wherein the supporter comprises:

a piston coupler coupled with the piston flange, the piston coupler having a circular plate shape that extends in the radial direction and supports a rear surface of the piston flange, a magnet coupler that is coupled with the magnet frame and receives a rear end of the magnet frame in an inner side of the magnet coupler, the magnet coupler having a ring shape and extending forward in the axial direction from an outer side of the piston coupler, a spring coupler coupled with the resonance spring, and a plurality of bridges that connect the piston coupler, the magnet coupler, and the spring coupler to one another, wherein the piston coupler, the magnet coupler, the spring coupler, and the plurality of bridges are integrally formed by aluminum die casting, wherein a size of the inner side of the magnet coupler corresponds to a size of the outer side of the magnet frame, and wherein the rear end of the magnet frame received inside the magnet coupler is axially supported on the piston coupler.

2. The linear compressor of claim 1, wherein the piston coupler defines:

a muffler hole configured to receive a suction muffler; and piston holes that are arranged radially outside the muffler hole, and that are configured to receive piston fasteners for coupling the piston.

3. The linear compressor of claim 2, wherein the piston coupler is configured to contact the piston flange and to couple with the piston flange by the piston fasteners.

4. The linear compressor of claim 1, further comprising:

a magnet-fixing member that surrounds the outer side of the magnet frame, and that is configured to fix the magnet to the magnet frame.

5. The linear compressor of claim 4, wherein the magnet frame is at least partially bonded to the inner side of the magnet coupler, and wherein at least a portion of the magnet-fixing member surrounds the outer side of the magnet coupler.

6. The linear compressor of claim 1, wherein the spring coupler is axially spaced from the piston coupler and the magnet coupler, and protrudes in the radial direction further than the piston coupler and the magnet coupler.

7. The linear compressor of claim 1, wherein the plurality of bridges comprise:

spring bridges configured to connect a plurality of spring couplers; and body bridges configured to connect the spring bridges, the piston coupler, and the magnet coupler.

8. The linear compressor of claim 7, wherein the spring bridges have a ring shape connecting the spring couplers that are circumferentially spaced from each other.

9. The linear compressor of claim 8, wherein the plurality of bridges further comprise:

assistant bridges that extend in the radial direction outward from the spring couplers, and that each connects a respective pair of the spring couplers.

10. The linear compressor of claim 9, wherein an axial length of the assistant bridges is larger than an axial length of the spring couplers.

11. The linear compressor of claim 8, wherein the body bridges extend in the axial direction from the spring couplers to the piston coupler and to the magnet coupler.

12. The linear compressor of claim 1, wherein the plurality of bridges further comprise:

assistant bridges configured to connect a plurality of spring couplers, wherein an axial length of the assistant bridges is larger than an axial length of the spring couplers.

13. The linear compressor of claim 12, wherein the axial length of the assistant bridges is twice the axial length of the spring couplers.

14. The linear compressor of claim 12, wherein the spring couplers are composed of a plurality of pairs of spring couplers that are circumferentially spaced from each other, and wherein the assistant bridges each connects a respective pair of the spring couplers.

15. The linear compressor of claim 1, wherein the magnet coupler surrounds an outer circumferential surface of the piston coupler.

16. The linear compressor of claim 1, wherein the piston coupler extends radially inward from an inner circumferential surface of the magnet coupler.

17. The linear compressor of claim 1, wherein the rear surface of the piston faces the supporter and is in contact with a front surface of the piston coupler.

18. The linear compressor of claim 1, wherein the rear end of the magnet frame is in contact with a front surface of the piston coupler.

19. The linear compressor of claim 1, wherein a front surface of the piston coupler is disposed rearward relative to the rear surface of the piston flange and in contact with the rear surface of the piston flange.

* * * * *